US005822826A

United States Patent [19]

Parker

[11] Patent Number: 5,822,826

[45] Date of Patent: Oct. 20, 1998

[54] DECORATING PAINT APPLYING DEVICE

[76] Inventor: Merilyn Stevens Mitchell Parker, Rte. 4, Box 499, Hickory, N.C. 28602

[21] Appl. No.: 647,791

[22] Filed: May 15, 1996

[51] Int. Cl.[6] ..... A47L 13/16

[52] U.S. Cl. ..... 15/244.4; 15/244.1; 15/210.5

[58] Field of Search ..... 15/244.1, 244.2, 15/244.3, 244.4, 210.5; D32/40, 43, 52; D28/63; D4/137

[56] References Cited

U.S. PATENT DOCUMENTS

| | | | |
|---|---|---|---|
| D. 186,499 | 11/1959 | Arrix | D28/63 |
| D. 186,500 | 11/1959 | Arrix | D28/63 |
| D. 271,817 | 12/1983 | Collin . | |
| 1,586,337 | 5/1926 | Stockwell | 15/228 |
| 2,841,811 | 7/1958 | Carroll | 15/244.1 |
| 3,465,377 | 9/1969 | Thomas | 15/244.1 |
| 4,030,414 | 6/1977 | McGuire . | |
| 4,111,666 | 9/1978 | Kalbow | 15/244.4 |
| 4,343,061 | 8/1982 | Hanazono | 15/244.3 |
| 4,483,036 | 11/1984 | Sayklay . | |
| 4,791,695 | 12/1988 | Kephart . | |
| 4,866,806 | 9/1989 | Bedford | 15/244.4 |
| 4,969,226 | 11/1990 | Seville | 15/244.4 |
| 5,007,128 | 4/1991 | Englund . | |
| 5,650,384 | 7/1997 | Gordon | 15/244.4 |

FOREIGN PATENT DOCUMENTS

| | | | |
|---|---|---|---|
| 838491 | 5/1952 | Germany | 15/244.4 |
| 200246 | 7/1923 | United Kingdom | 15/244.4 |
| 1092902 | 11/1967 | United Kingdom | 15/118 |
| 8909014 | 10/1989 | WIPO | 15/118 |

*Primary Examiner*—Randall E. Chin

[57] ABSTRACT

A decorating paint applying device and method is disclosed, which is helpful for painting floral and leafy vegetation or special effects having a 3-dimensional effect. The device is composed of a one piece, unitary, paint retaining, compressible, resiliently self-restoring soft body having two designing surfaces with a compressed middle portion. The top surface is defined by a number of upstanding projections being independently compressible, and a flat undersurface. The body has outside edges defined by a number of protrusions. Manual handling of the device in applying paint to the body, thereafter correctly positioning and compressing to apply, produces alternating painted and unpainted areas depicting clusters of spaced apart leaves and floral petals or special effects. The method consists of applying threads of varying colors of paint onto the device which has been wet with a base color. Next, folding and compressing to mingle colors and applying by compressing onto a receptive surface.

5 Claims, 10 Drawing Sheets

Fig. 1.A
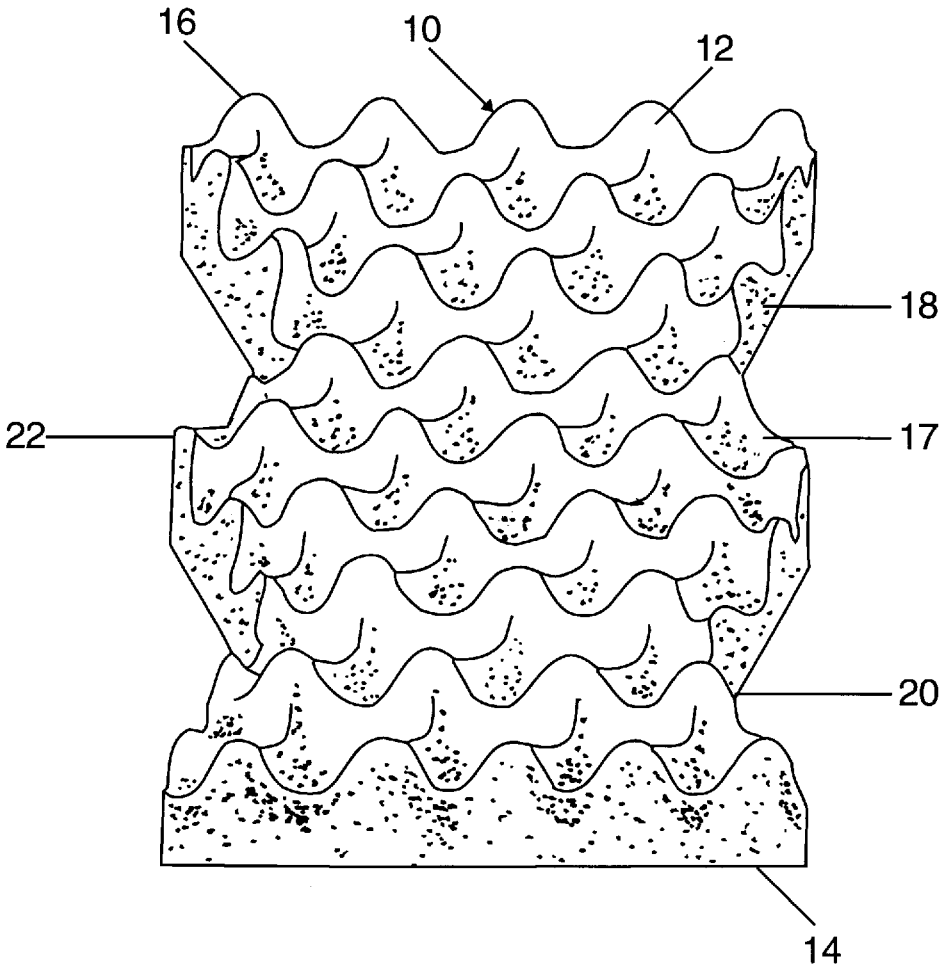

Fig. 1.B
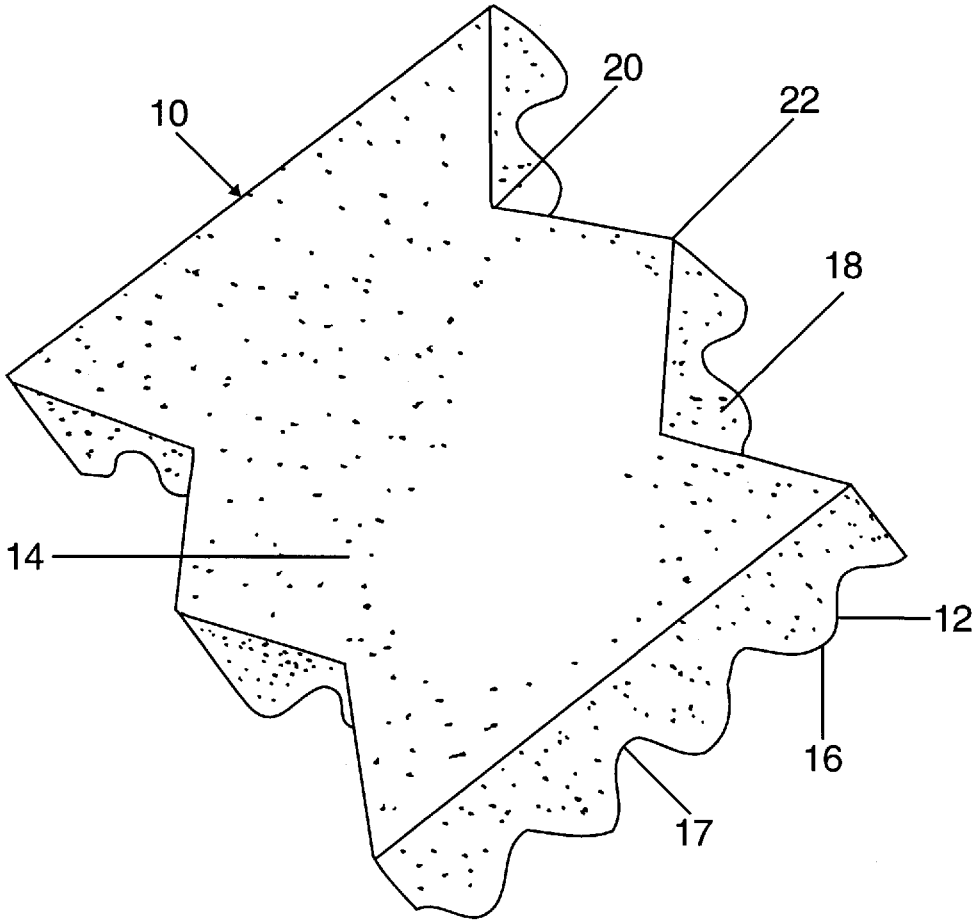

Fig. 1.C
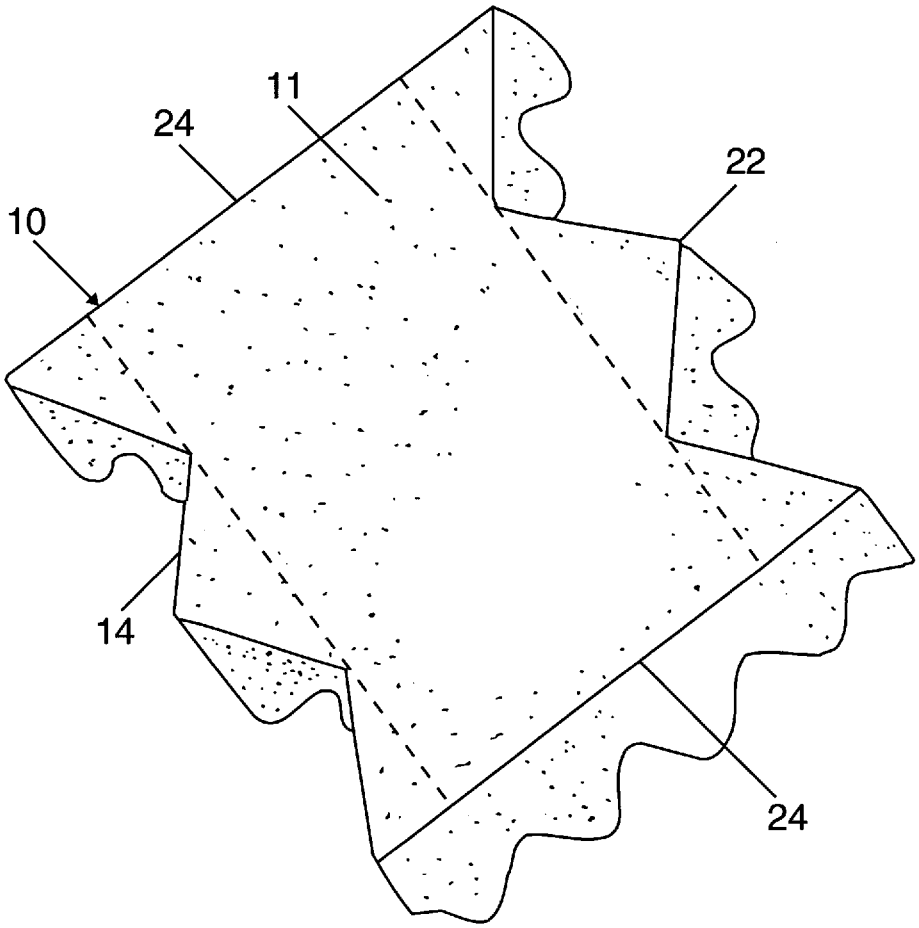

Fig. 2.A
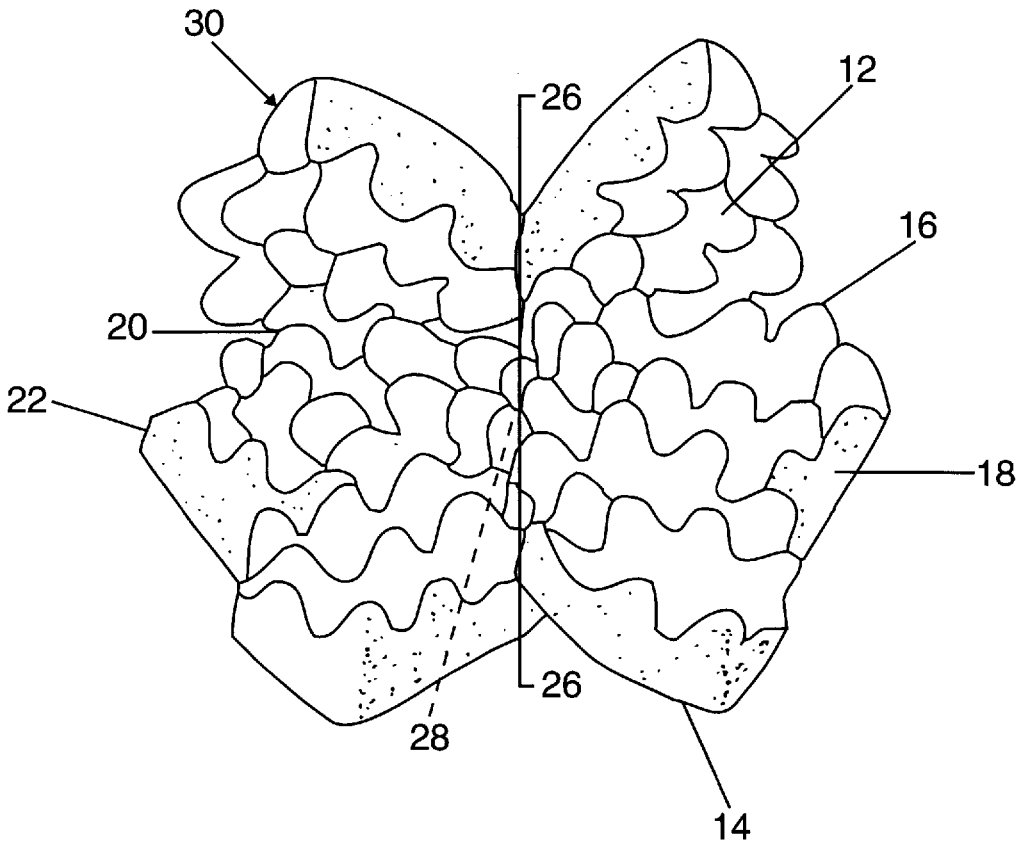
Fig. 2.B
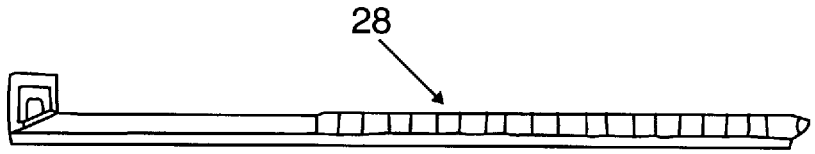

Fig. 3.A
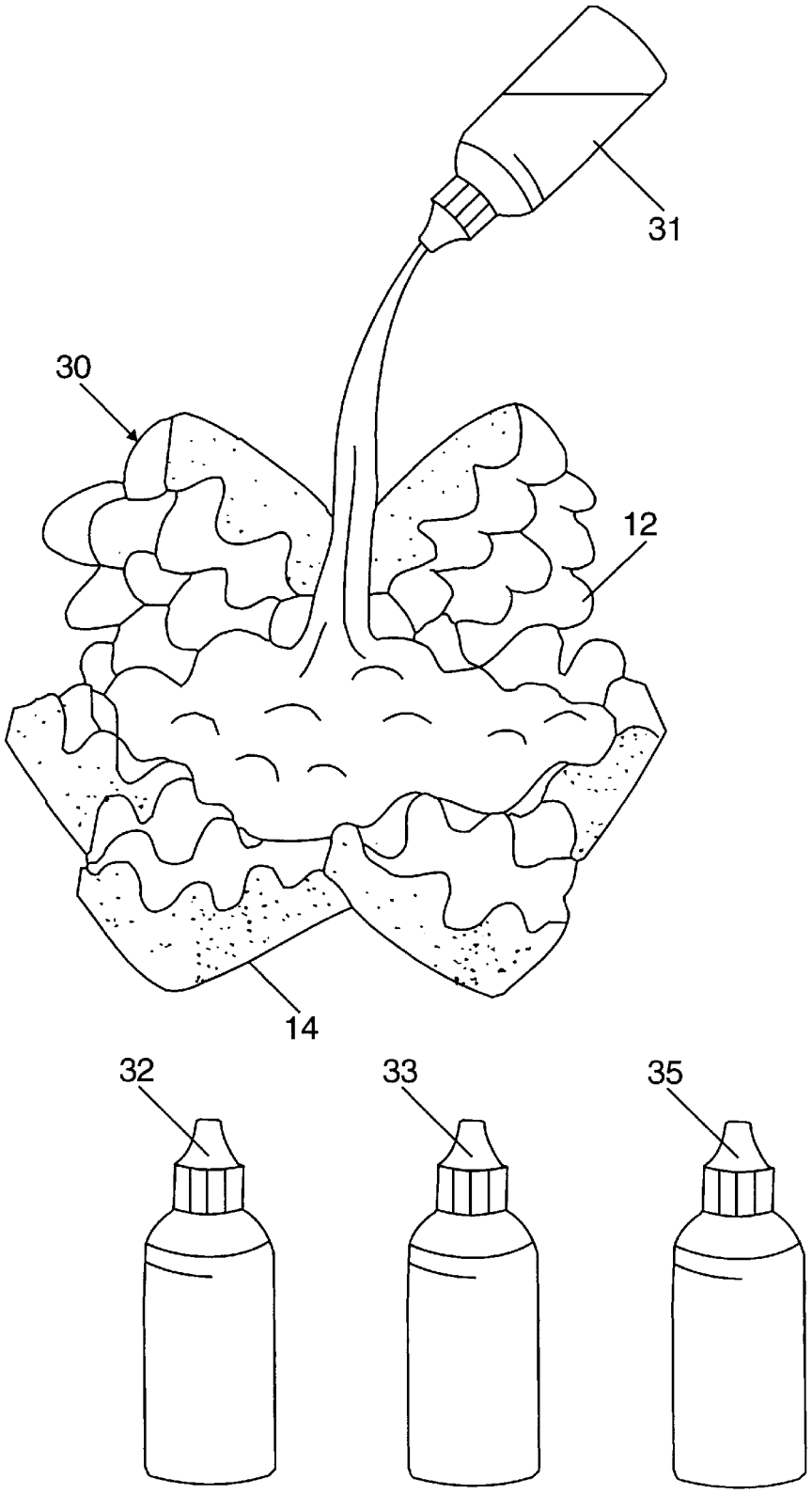

Fig. 3.B
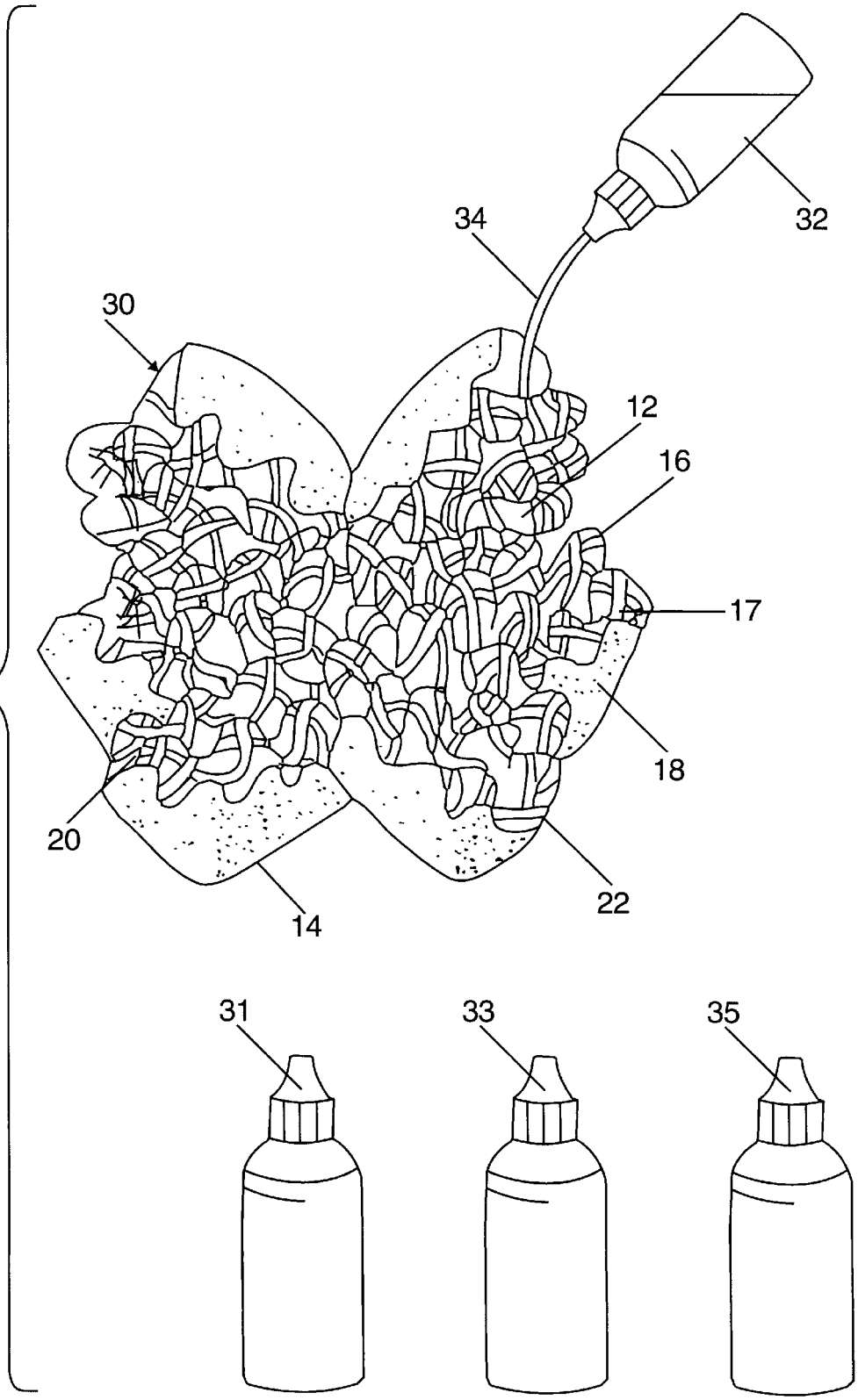

Fig. 3.C
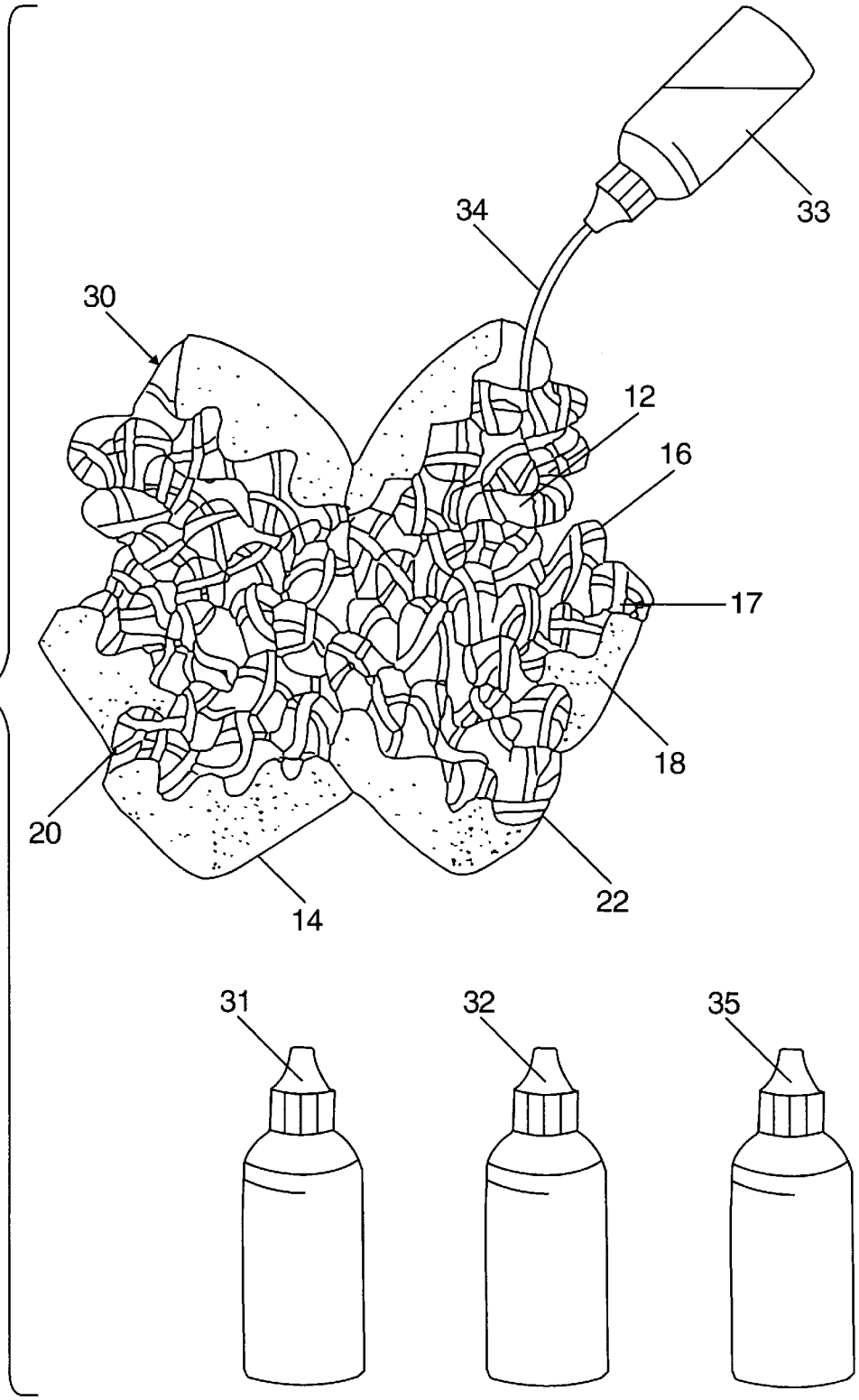

DECORATING PAINT APPLYING DEVICE

FIELD OF INVENTION

This invention relates to sponge paint applicators which are adapted for effective wall decoration to be used by beginning to skilled artists.

BACKGROUND

Various methods have been employed by artists, particularly beginning or intermediate artists to simply and efficiently paint leafy vegetation such as greenery and flowers or special pattern effects to decorate a wall surface. Producing such effects are extremely difficult and time consuming to achieve with a typical artists brush. Because of this, certain painting aids have been developed. One of the most common is the sponge.

While conventional sponges and artist's brushes are adequate for the skilled artist; the novice, unsure of his or her ability could greatly benefit from a device which by its very composition and shape along with the paint method is capable of attractively depicting a variety of greenery, floral vegetation, and special effects as an encouraging assist to the novice or to assist the skilled artist, more simply and quickly with professional looking results.

An example of a wall decorating paint applying device which is in effect, a painting aid, will be noted in U.S. Pat. No. 4,030,414, James T. McGuire, Jun. 21, 1977 provides a block sponge body with a built in rear side handle, having a relief designing face and side for reproducing the exact design or portion of the design on the block body.

This aid suffers from several drawbacks; one is that it repeats the exact relief pattern or portion there of limiting the design by subject choice, size and shape. It cannot produce dabs of paint representing leaves and petals or create special effects like marble nor does it provide for shading in each application. This aid does not allow all surfaces to apply paint or be compressed greatly without destroying the relief pattern.

The disadvantages of the prior art are overcome by the present invention, and an improved decorating paint applying device is provided for assisting the beginning to skilled artist in depicting from one leaf or flower petal to clusters of leafy and floral vegetation, having a three dimensional appearance, per application and other specific pattern effects.

SUMMARY OF INVENTION

An improved decorating paint applying device is provided for depicting leafy and floral vegetation or textures such as marble, leather and the like. The device is comprised of a one piece, hand held, flower shaped, flexible, unitary soft compressible, resiliently self restoring, deformable, cellular paint retaining sponge body having a face with a plurality of independently compressible upstanding projections, a flat under surface and a number of protruding outside edges. These projections and protrusions may be round, triangular, oval, toothed or any other shape or length.

When such a device is filled with paint and applied by compressing to a surface to be decorated, the projections and protrusions produce dabs of paint varying in size and shape with some spaced apart and some connecting arranged in a flower shaped pattern which can be altered by manual manipulation. One or more application can produce the desired effect with varying shape and density of the paint dabs within a given area closely resembling clusters of leaves, or flower petals and effects like marble or leather. When the device is used with the paint applying method, the paint dabs have a beautiful shaded three dimensional effect with distinction and definition per application.

The present invention therefore allows the decorating artist, particularly the beginning and intermediate artist in a matter of seconds to attractively depict impressionistic leafy and floral vegetation as ivy, geraniums, lilies, roses and the like or various effects and textures as marble, leather and the like. Such depictions are much more attractive and simply produced than those effected by other means.

It is a feature of the present invention to easily, inexpensively, and very quickly, produce various impressionistic representations of leafy and floral vegetation and other specific pattern effects in decorative paintings on walls, floors, furniture and the like which is very effective on difficult surfaces that are rough, broken, curved, sloped, or rounded.

It is yet another feature of the present invention to provide a device with easy handling, flexing and compressing necessary to effectively create depictions varying in size, shape and patterns appearing more realistic with a three dimensional effect.

It is a further feature to provide a device with all surfaces usable, having a superior surface for reception, retention and applying of paint, capable of many repeated quality applications before refilling, with little mess and easy clean up.

It is yet another important feature to provide a device to be used with the paint applying method producing shaded, three dimensional effects during each application, which very attractively defines and enhances the depictions.

These and other features and advantages of the present invention will become apparent from the following detailed description, wherein reference is made to the figures in the accompanying drawings.

BRIEF DESCRIPTIONS OF THE DRAWINGS

FIG. 1A is a pictorial front view of the sponge body, showing a face with a number of discrete upstanding projections and two outside opposite edges notched and generally planar undersurface.

FIG. 1B is a pictorial back view of the sponge body having a generally planar surface and two opposite edges notched.

FIG. 1C is a pictorial back view of the main body being a portion within the body excluding the protrusions.

FIG. 2A is a pictorial front view of a fully constructed device with the medial portion gathered and secured by FIG. 2B a locking tie hidden within the device producing a different flower shape pattern while angling and compacting the projections and side walls to deliver various shaped paint dabs.

FIG. 3A is a pictorial view of the device and squeeze bottles of paint illustrating the base color being applied in the paint applying method. FIG. 3B is a pictorial view of the device and squeeze bottles of paint showing the main color being applied in a swirling thread over the entire surface as a second step in the paint applying method. FIG. 3C is a pictorial view of the device and squeeze bottles of paint illustrating the application of the varying shades in swirling threads over the entire surface as the third step in the paint applying method.

Figure 4:
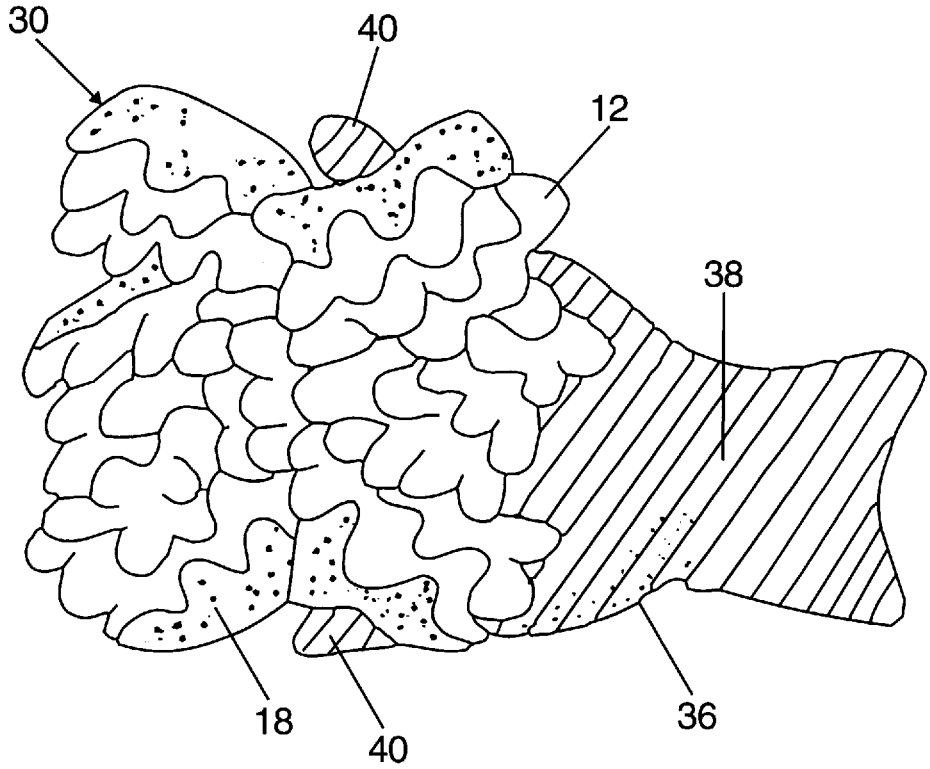

FIG. 4 is a pictorial view of the device held in a hand illustrating the device being manipulated for preparation and application.

Figure 5:
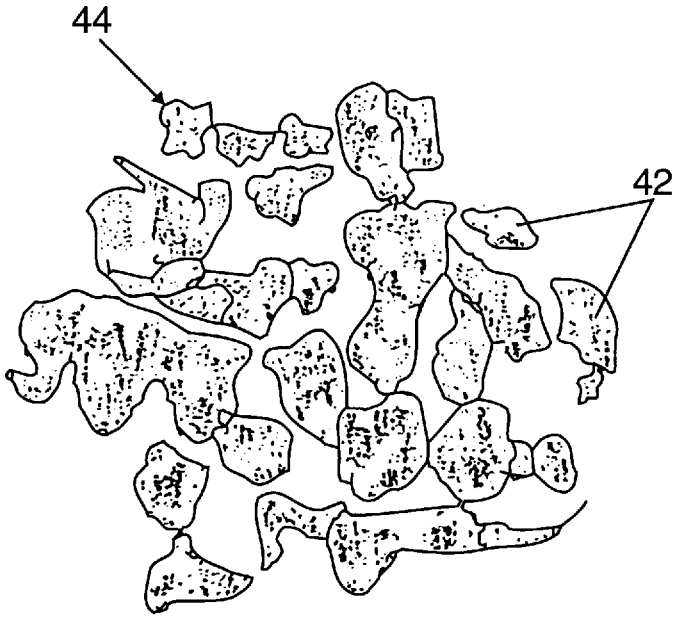

FIG. 5 illustrates the manner in which the face projections fully engaged produce multi shaped dabs arranged in a rounded flower pattern and can be applied in that pattern to depict a multi-petal flower or applied to depict clusters of small leaf greenery such as ivy or trailing vine leaves.

Figure 6:
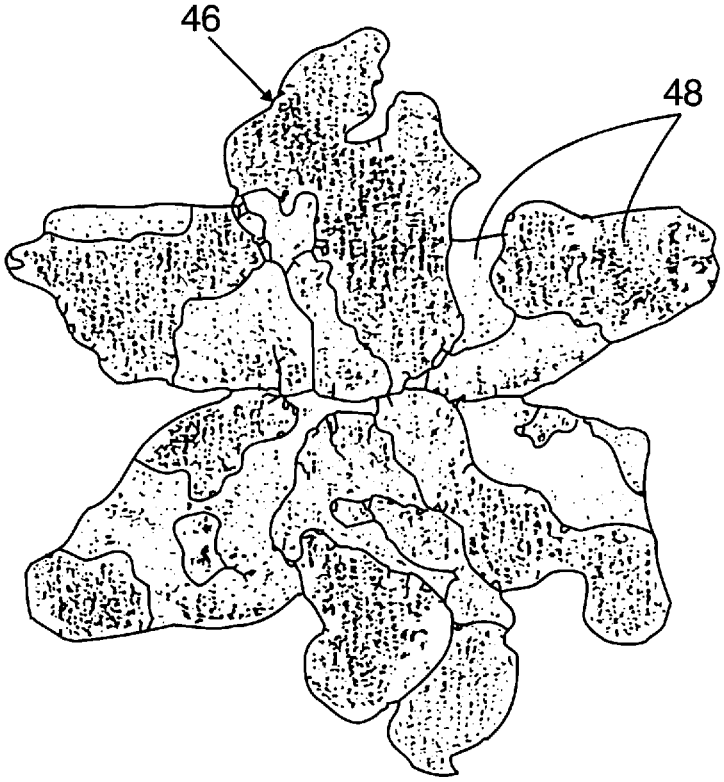

FIG. 6 represents other formations reproducible by full engagement of the undersurface of the paint applying device showing a pattern of six (6) elongated petals projecting from the center of the flower pattern consisting of larger dabs varying in size, shape and density depicting a lily or hibiscus flower or a cluster of elongated leaves.

| Part | Number | Part | Number |
|---|---|---|---|
| Body | 10 | Base Color | 31 |
| Main Body | 11 | Main Color | 32 |
| Face | 12 | 1st Varying Shade | 33 |
| Undersurface | 14 | Paint Thread | 34 |
| Upstanding Projections | 16 | 2nd Varying Shade | 35 |
| Recessed Areas | 17 | Hand | 36 |
| Side Wall | 18 | Palm | 38 |
| Notch | 20 | Finger | 40 |
| Protrusion | 22 | Face Paint Dabs | 42 |
| Straight Edge | 24 | Face Dab Pattern | 44 |
| Body Center | 26 | Undersurface Dab Pattern | 46 |
| Locking Tie | 28 | Undersurface Paint Dabs | 48 |
| Paint Applying Decorating Device | 30 | | |

DETAILED DESCRIPTION

Referring now to FIG. 1A one embodiment of the present invention is depicted for use in painting floral and leafy vegetation or special effects and the like. The upstanding projections referred to here in are formed by a convoluter and it should be understood that the projections can be any height or shape, either triangular, pointed, oval, or any other shape such as sinuous peaks and valleys as shown in FIG. 1. Different projection heights, lengths and shapes transfer paint with slightly different effects on a surface being painted. As shown in FIG. 1, the decorating paint applying device 30 is comprised of one piece sponge body 10, having a face 12, with upstanding projections 16, being a minimum height equal to ½ the body thickness, with recessed areas 17 in between, being generally equal to the projections. The sponge body 10 is a resilient, self restoring, cellular, paint retaining, absorbent material.

The body 10 having two opposite sides with two "v" shaped notches 20, generally at 45° angles, spaced equally apart, producing three protrusions 22 on said sides, with the remaining opposite edges 24 being straight and the said body 10 having a generally planar or flat undersurface 14. Notches 20, forming protrusions 22, have side walls 18. The protrusions serve to transfer paint dabs in a flower pattern or elongated leaf pattern. The sponge body is constructed of synthetic foam which provides good compression and pliability as well as paint retaining and transferring qualities. The recessed areas 17 are not vital but serve to hold paint when it is being applied and the projections 16 serve to transfer paint in various shape dabs.

FIG. 1B is a pictorial back view of the body 10 undersurface 14 is generally planar, having the same outside edge shape as the face 12, for transferring paint in the form of dabs unequal in size and shape, with darker and lighter density connected in the shape of the device 30's undersurface 14, when fully compressed. The side walls 18 are also shown in this Figure.

FIG. 1C is a pictorial back view of the main body 11. The main body is a rectangular portion within the body 10 excluding the protrusions 22. This is shown to clarity the terminology used in the specification. The main body 11 is the interior portion of the sponge 10 having four straight sides which does not include the protrusions 22. Two of these straight sides are the edges of the sponge, the other two are depicted by dash lines in FIG. 1C.

FIG. 2A illustrates a preferred embodiment of the device wherein a completely constructed device 30 has been compressed, cinched or compacted by preferably a plastic locking tie 28 hidden within the center body 26. The locking tie encircles and gathers the medial portion from opposite centers of each straight outside edge 24, so that it is tightly drawn and secured forming a flower shaped device 30, providing two extremely flexible sides, while clustering and compacting the upstanding projections 16 at varying angles, drawing the entire body of the device toward the center exposing some of the body side walls 18. FIG. 2B shows the locking tie 28 having a clasp to slide the ribbed tab into, which prevents the tab from sliding backward or becoming loose. Such construction is effective for providing various shapes for transferring paint in the form of dabs, ranging in size, shape and direction. Each dab is capable of depicting a leaf or petal or collectively depicting clusters of leaves or petals. The body 10, as shown in FIG. 1A and 1B, when used to apply paint without the locking tie is less flexible, awkward to handle and is less effective for leaf and floral depictions. However, any means of compressing the medial portion, can be substituted for the locking tie. One can even compress the medial portion with two fingers, but then the applicator becomes awkward to handle. Also, this paint applicator is useful without the tie for depicting marble and leather. With the compressed center the device 30's face 12 transfers paint in many small varying shaped paint dabs 42, arranged within a gently rounded flower shaped pattern 44, depicting various multi-petaled flower or clustered leaves, while the undersurface14 transfers larger paint dabs 48, with varying density and shape, arranged within an elongated six petal flower pattern 46, depicting lily type blossoms or leaves clustered. The device 30 could be manufactured in a way such as casting in a mold to produce the same effects as compressing with the locking tie 28, making the tie 28 unnecessary. The device 30 could be constructed with a rotating handle for compressing and securing the center body 10, having a plate or disc for pressing, mounted on said handle, able to slide on and off allowing hand manipulation.

The paint applying method for creating 3-dimensional effects is described in FIG. 3A, 3B, and 3C which includes five steps of preparation and a sixth step of application. The method may be used on the face 12 or undersurface 14 in the same manner, in preparation for floral or foliage depictions as well as special effects. FIG. 3A is a pictorial view of the device 30, as shown in FIG. 2, including squeeze bottles of paints; base color 31, main color 32, 1st varying shade 33, 2nd varying shade 35, used in the paint applying method and illustrating the first step. Only the base color 31 is being used in this step. Step 1A: the base color paint 31 is poured onto the device 30 using a sufficient amount, approximately 2 ounces, to lightly saturate the entire surface 12 or 14. Step 1B: next fold the device 30, surface 12 or 14, to touch itself and compress to distribute paint 31 evenly over and within the entire surface, including all protrusions 22 and side walls 18. The device 30 may be dipped into the base color 31 as the manner of application is not restricted to pouring, but is less messy and convenient. The base color 31 is selected to add dimension and highlights by making areas lighter or darker without overpowering the main color 32. I find white, cream, or tan usually work well for greenery and flowers.

When creating marble or leather effects, a lighter or darker shade of the main color 32 works well. FIG. 3B is a pictorial view of the device 30 including squeeze bottles of paint colors 31, 32, 33, 35, to illustrate the second step of the paint applying method. The face 12 is shown, previously wet, with the base color paint 31. Step 2: the main color paint 32 is applied in threads 34 or ribbons in overlapping swirls by means of squeezing from a bottle or drizzling from a stir stick. The other paint bottles 31, 33, and 35 are not actually used in this step. The main color 32 is the dominate color for identifying the depictions, such as red for roses or green for foliage. FIG. 3C is a pictorial view of device 30 including squeeze bottles of paint colors 31, 32, 33, 35 as shown in FIG. 3A & 3B, to illustrate the third step of the paint applying method. The face 12, previously wet, with the base color paint 31 and main color paint 32 which was applied in threads 34, as previously shown in FIG. 3A & 3B. Step 3: shades 33 and 35 are applied in the same manner as the main color 32, by threads 34, in overlapping swirls, using sufficient amount of paint 32, 33 and 35 to cover about 80% of the body 10's surface 12 or 14 from edge to edge. The varying shades 33 and 35 are not essential, but will add more depth to the depiction, and are necessary for depicting some types of flowers having multiple colors. The varying shades 33, 35 will be colors that enhance the depiction and may be in a different color family from the main color 32. Typically shades 33 & 35 will be a warm tone and a cool tone of the main color 32. An example: to depict green leaves the colors may be; emerald green—main color 32, yellow green—1st varying shade 33, blue green—2nd varying shade 35. Another example: to depict a rose, use true red—main color 32, yellow red—1st varying color 33, blue red 2nd varying color 35. The amount of each color 33, 35 can vary depending upon the species being depicted but often equal amounts of each will work well. The varying shades 33, 35 give highlight and dimension to the depictions along with the base color 31, which moves forward and intermixes with colors 32, 33, 35 during application giving even more variations of colors. Step 4: gently intermingle said colors 32, 33, 35 by manually flexing and folding paint filled surface 12 or 14 to touch itself compressing to intermingle and mix while still retaining a hint of original colors. On this step allow the side walls 18 to pick up colors. Step 5 (optional): floral depictions may be enhanced and defined by using complimentary paint colors on selected portions of the device such as yellow on the medial portion, depicting a flower center or applying a thin thread 34 of white on selected areas of the surface 12 or 14 to create a variegated blossom or foliage. The highlighting colors should be gently pressed or smoothed into the device 30 with a finger or stick. Do not compress. Before applying, making a test application on a scrap paper can be helpful to determine any adjustments needed. If the device is too dry add more paint 32,33 & 35 as needed. Excess paint can be removed by making several applications on scrap paper. At this point, test holding and manipulating the device 30 to aid in creating the desired depiction. Step 6: apply by compressing the device 30, with light to moderate pressure, without shifting or turning, on a surface to be painted. Lift to reapply in a pattern to achieve a desired depiction. When making one application, using the method, provides a well formed flower or cluster of leaves beautifully highlighted with a three dimensional effect.

FIG. 4 is a pictorial front view of the device 30, as shown in FIG. 2 and 3, which is hand held by palm 38 and extended fingers 40 of hand 36, grasping the notched areas 20 for manual manipulation, for paint preparation, squeezing and compressing to apply. Desired size depictions are achieved by compressing the full face 12 or undersurface 14 or manipulating the device 30 in various ways such as folding, wadding, squeezing and compressing to alter the arrangement of paint dabs and shape of the device. Then the sponge is applied in an appropriate pattern making as many applications as necessary. Flowers are usually depicted by confining the paint dabs inside a flower pattern, while leaves usually can be depicted by applying the dabs in a flowing, trailing or sweeping pattern as leaves on a vine or branch. When engaging the face 12 to apply paint, with palm 38 and fingers 40 open, lightly pressing most of the device 30 to a paintable surface produces small spaced apart or partly connected paint dabs, confined in a rounded pattern depicting a multi-petaled blossom such as a rose, mum or the like or a cluster of leaves such as ivy. Continued applications in the appropriate pattern and location will help identify the depiction. The more tightly the fingers 40 are closed around the device, the smaller and more compacted the paint dabs. This produces a smaller pattern to depict a small flower or bud or small cluster of leaves. When engaging the undersurface 14, to apply paint with palm 38 and fingers 40 open, lightly pressing most of the device 30 produces an elongated six petal flower shape 46 with a center, depicting a lily or hibiscus type blossom or a cluster of elongated leaves, consisting of mostly connected paint dabs with varying degrees of density and shape. Light to moderate hand 36 pressure is usually sufficient to transfer paint from a paint filled device. The firmer the pressure the larger and more connected the dabs. A flat disc or plate can be used as a press to achieve a fuller and darker imprint. When pressing with one or more fingers 40 a portion of the device 30, such as a protrusion 22 or projection 16, can produce one dab to depict a leaf, petal or bud. A section may be folded to engage an exact surface for a smaller version of a large pattern. Many applications can be made with a filled device. I have made up to 40 before reloading. The top three colors may be reapplied without reapplying the base color, when the colors being deposited are too light or milky. Otherwise, always clean and towel dry the device 30 before reloading or loading with a new main color 32. Easy water rinsing is all that is necessary when using latex paints to clean the sponge. Use paint thinner to clean the sponge when oil based paint is used.

FIG. 5 is a pictorial view of paint dabs 42 arranged in a paint pattern 44 consisting of many small varied shaped paint dabs 42. They are produced by engaging the projections 16 of the face 12 surface and side walls 18, pressing with an open hand. This paint dab pattern 44 is used to depict fluffy flower blossoms of various species such as roses, peonies, hydrangeas, dahlias, geraniums and the like. More than one application may be necessary to achieve fullness of some types of flowers. This is achieved by slightly shifting the device 30 and reapplying over the first application. Squeezing the device to engage a smaller portion of the face 12 can depict smaller type blossoms such as carnations, roses, and begonias or clusters of small leaf greenery such as ivy or trailing vine foliage. Varying the size of depictions can produce a more realistic appearance along with brush painting in stems, vines and branches. Slightly altering the flower shaped paint dab pattern 44, by gently squeezing and applying without opening the hand, arranges the paint dabs randomly. This produces a more natural pattern for depictions of small leaves, clustered as in ivy or foliage of climbing rose vines, with continuing applications placed in a vine pattern. These paint dabs 42 can be applied and arranged in a stalk or spike pattern to depict gladiolus or the like. A round paint dab can be produced by pressing a projection 16 with one finger from the undersurface 14 to depict a grape or round blossom.

The face pattern 44 of dabs 42 serve well to depict marble. The device 30 face 12 can be prepared following the method of FIG.3A, 3B, and 3C, using repeated applications to cover a surface that has been pre-painted with a solid coat of the main color 32. A different method is to use the main color 32 as the base color 31. Use small amounts of two colors found naturally in marble, such as white and gray, as the two varying shades 33, 35 following the method of FIG. 3A, 3B and 3C apply with close repeated applications.

To depict leather, the pattern of dabs 44 and 46, produced by the face 12 or undersurface 14, works well, following the steps as for marble when the device 30 is saturated with a main color 32 which is the dominate color. Next apply two varying shades 33, 35, one lighter and one darker, of the main color 32. Intermingle the colors by folding the face to touch itself and compress then apply using very close applications until the surface to be decorated is covered.

FIG. 6 is a pictorial view, illustrating the undersurface paint pattern 46 consisting of paint dabs 48 varying in size, shape and density, due to the face projections 16 preventing equal pressure when compressing the undersurface 14 to a paint receptive surface. Pattern 46 is effective for depicting elongated petal blossoms as well as elongated leaves. When folding the device 30 in half, a cluster of three leaves can be depicted or various types and stages of floral patterns can be depicted. This pattern 46 can also be used to produce different textures than the face pattern 44.

It is thus seen that a versatile device 30 along with a paint applying method FIG. 3A, 3B, and 3C has been provided which includes a face surface 12 where the upstanding projections 16 each act as individual paint applicators, which can be used to transfer paint, individually and collectively, to produce different size shapes, and patterns 44 depicting a multi-petal flower or cluster of leaves per application. The protruding outside edges 22 serve to produce a natural floral or greenery pattern. The planar undersurface 14 provides a 2nd arrangement of paint dabs 46 depicting a lily type blossom or cluster of elongated leaves. The two sided device 30 allows various design capability because it has different patterns and texture producing surfaces, for depicting various types of foliage and flowers, as well as special effects like marble or leather. The device used with the paint applying method illustrated in FIG. 3A, 3B and 3C can provide a novice or skilled artist quick, easy and inexpensive means to decorate walls, furniture, floors, ceilings or the like with very beautiful three dimensional depictions and special effects.

As many possible embodiments may be made of this invention without departing from the spirit or scope there of it is to be understood that all matters herein set forth in the accompanying drawings are to be interpreted as illustrative and not in any limiting sense.

What is claimed is:

1. A greenery and floral, wall decorating, paint device for obtaining a decorative pattern comprising:

a means for applying paint, said means is a resilient self restoring, paint retaining material having sides, said means also having a face and an undersurface in addition to said sides, said undersurface is flat, wherein at least a part of said sides is straight, forming a straight portion, said means having a main body, in addition to said straight portion, said sides also have at least three protrusions, said protrusions each have only two sides, both of these sides are straight, said protrusions protrude from said main body, wherein the two sides of a first of said protrusions are formed from legs of two adjacent v shaped notches;

wherein a first part of said straight portion is an integral part of said main body, a second part of said straight portion forms one of the two sides of a second of said protrusions, a third part of said straight portion is one of the two sides of a third of said protrusions, the other of said sides of said second and third protrusions are each one leg of a different v notch;

wherein said face has a number of projections separated by valleys that are rounded, said valleys are formed within said material, said projections have a cross section parallel to said undersurface, said cross section being round, wherein each of said protrusions has at least part of one of said projections;

said projections are unclustered and uniformly distributed, all of said projections pointing in only one direction, when said means for applying paint is in an uncompressed state;

a means for retaining said means for applying paint in a compressed state, when in the compressed state, said means for applying paint is cinched tight enough to deform said means for applying paint such that some of the projections are clustered and point in varying directions.

2. A device, as defined in claim 1, having two straight portions.

3. A device, as defined in claim 1, wherein said means for retaining is a means for compressing.

4. A device, as defined in claim 3, wherein said means of compressing is a tie.

5. A device as defined in claim 1 wherein each of said v shaped notches are formed from a pair of legs that meet at an apex, said apexes are positioned such that if a straight line is drawn connecting the apexes of any two adjacent v shaped notches, this line will be perpendicular to said straight portion.

* * * * *